US007982628B2

(12) United States Patent
Plocher et al.

(10) Patent No.: US 7,982,628 B2
(45) Date of Patent: Jul. 19, 2011

(54) METHOD AND SYSTEM OF TRANSLATING DEVELOPING CONDITIONS IN SPATIAL GEOMETRIES INTO VERBAL OUTPUT

(75) Inventors: Thomas A. Plocher, Hugo, MN (US); Henry Chen, Beijing (CN)

(73) Assignee: Honeywell International Inc., Morristown, NJ (US)

( * ) Notice: Subject to any disclaimer, the term of this patent is extended or adjusted under 35 U.S.C. 154(b) by 275 days.

(21) Appl. No.: 12/260,559

(22) Filed: Oct. 29, 2008

(65) Prior Publication Data

US 2010/0102983 A1 Apr. 29, 2010

(51) Int. Cl.
*G08B 3/00* (2006.01)
*G08B 17/10* (2006.01)
*G08B 9/00* (2006.01)

(52) U.S. Cl. ..... 340/691.6; 340/691.1; 340/692; 340/628; 340/629; 340/630; 340/286.02; 340/286.11; 340/632

(58) Field of Classification Search ..... None
See application file for complete search history.

(56) References Cited

U.S. PATENT DOCUMENTS

| | | | | |
|---|---|---|---|---|
| 4,288,789 | A * | 9/1981 | Molinick et al. | 340/524 |
| 6,600,424 | B1 * | 7/2003 | Morris | 340/628 |
| 2001/0043144 | A1 * | 11/2001 | Morris | 340/692 |
| 2005/0105743 | A1 * | 5/2005 | Faltesek et al. | 381/82 |
| 2006/0063523 | A1 * | 3/2006 | McFarland | 455/423 |
| 2006/0071802 | A1 * | 4/2006 | Right et al. | 340/628 |
| 2007/0024455 | A1 * | 2/2007 | Morris | 340/577 |
| 2007/0080819 | A1 * | 4/2007 | Marks et al. | 340/628 |
| 2008/0040669 | A1 * | 2/2008 | Plocher et al. | 715/727 |
| 2008/0309502 | A1 * | 12/2008 | Boccia et al. | 340/578 |

OTHER PUBLICATIONS

European Search Report corresponding to application No. EP 09 17 3957, dated Dec. 4, 2009.

* cited by examiner

*Primary Examiner* — Julie Lieu
(74) *Attorney, Agent, or Firm* — Husch Blackwell

(57) ABSTRACT

A verbal language based output system includes data defining a geometrical region, such as a building, configuration data relative to various detectors in the region, and a plurality of event inputs associated with the detectors. Verbal language generation software, in response to the data and the event inputs, produces verbal descriptions of developing events. Such verbal descriptions can be audibly output for use by personnel needing to enter the region to address the events.

19 Claims, 10 Drawing Sheets

FIRST FLOOR PLAN

METHOD AND SYSTEM OF TRANSLATING DEVELOPING CONDITIONS IN SPATIAL GEOMETRIES INTO VERBAL OUTPUT

FIELD

The invention pertains to alarm condition indicating methods and systems. More particularly, the invention pertains to such methods and systems where spatially related information as to a developing alarm condition can be presented verbally.

BACKGROUND

The ability to send real time fire alarm updates and building information from the building fire alarm system to firefighters en route to the fire is currently available. FIG. 1 illustrates a known implementation. Information from a fire monitoring system 10 indicative of a developing fire condition can be wirelessly transmitted to fire fighting personnel for review via a display unit 12 while en route to the fire.

Mobile phones can be expected to be a frequent means for firefighters to receive the information.

Given the limitations of very small mobile phone screens to display building graphics, text plus digital speech/audio will be the common display modality as illustrated in FIG. 1.

As illustrated in FIG. 1, known presentations of alarm related information are via an alarm list. Such lists while accurate do not provide a spatially meaningful verbal or visual description of how the fire is spreading in the building. A traditional reading of an alarm list corresponds to:

Alarm 1 is at 10:05 PM on Floor 5

Alarm 2 is at 10:07 PM on Floor 5

Alarm 3 is at 10:14 PM on Floor 6

Hence, all spatial integration is carried out by respective first responders in potentially hectic conditions as they are traveling to the fire.

There is thus a need to be able to provide to first responders spatially meaningful verbal descriptions as to behavior of a fire condition. It would be useful to provide verbal information as to how a fire is spreading along a floor in a region, for example, without relying on the user studying alarm lists and attempting to extrapolate to the spatial behavior of the fire in the involved region.

DETAILED DESCRIPTION

Figure 1:
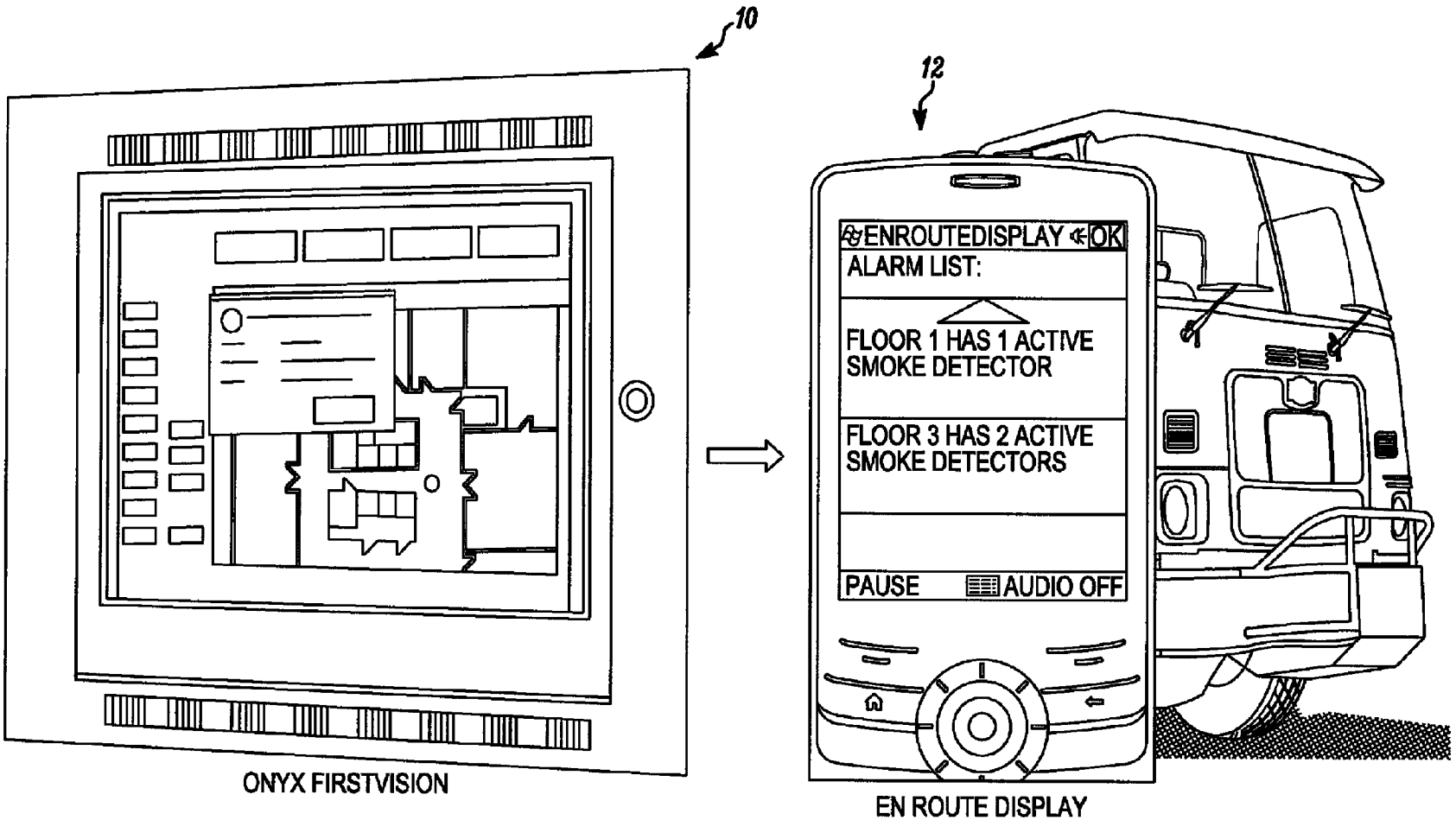
PRIOR ART FIG. 1
FIG. 1 illustrates a known type of active alarm list.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Embodiments of the invention address the above noted problems by providing spatially integrated verbal descriptions of how a fire is developing. The present system and method emulate how people would describe the spread of a fire in their own words if they were, for instance, trying to describe it to someone over the phone. For example, they might say something like, "it has spread down the hall" or "it has spread from floor 1 to floor 2". Thus embodiments of the invention describe the developing fire condition in spatially integrated and meaningful terms. For example, by temporal order, spatial order and domain.

In a disclosed embodiment, a model-based method is provided for automatically generating a spatially-meaningful description of fire spread from alarm and building information. The language of the text can be constructed from the temporal and spatial relationships of the alarms combined with the definitions of building features from a building semantic model.

For example, in one aspect of the invention, temporal order, spatial order and a building semantic model can be combined to produce a spatially meaningfully verbal output. Taking into account:

Temporal order. Alarm 3 activated after Alarm 2 which activated after Alarm 1, so the fire is spreading in the direction of Alarm 2, and then to Alarm 3;

Spatial order. Alarm 2 is east of Alarm 1, so the smoke is spreading "to the east" or Alarms 1 and 2 are on floor 5 and Alarm 3 is on floor 6, so the smoke is spreading "from floor 5 to floor 6"; and Semantic model. Both Alarm 1 and Alarm 2 are located in what the semantic model knows is a "hallway". In fact, given the alarm locations it is the "same hallway". In another aspect of the invention, the model also knows that "things move down hallways. So, together with the above, the smoke is spreading "down the hallway".

In yet another aspect, all three parameters above are combined to give the meaningful, verbal, spatial expression, such as:

"The smoke is spreading east down the hallway on Floor 5 and then onto Floor 6".

In embodiments of the invention, the automated spatial-geometric language does the spatial integration of the alarms for the user and presents the result in meaningful text, whereas the traditional alarm list reading leaves all the spatial integration up to the user and presents as very cryptic text. Embodiments of the present invention can be expected to provide much more effective communication of the fire spread, preferably verbally, using words.

Figure 2:
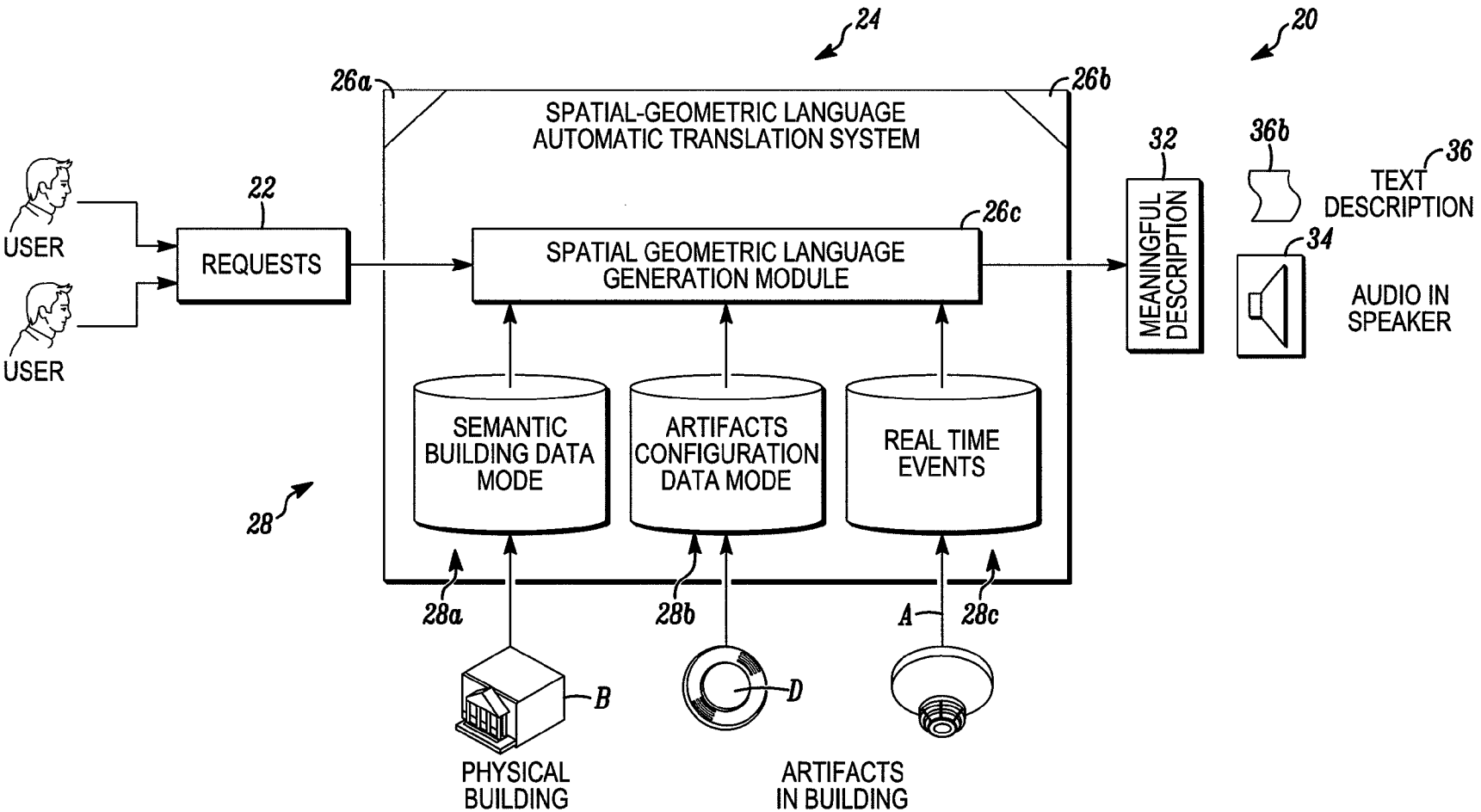
FIG. 2 illustrates a system in accordance with the invention.

FIG. 2 illustrates a system 20 in accordance with the invention. System 20 includes a requests input port 22 which is coupled to a computer based language system 24.

Language system 24 can be implemented with one or more programmable processors 26*a* in combination with control software 26*b* which is stored on a computer readable medium. One portion of the software 26*b* corresponds to a Spatial Geometric Language Generation Module 26*c*, discussed in more detail subsequently.

One or more storage units 28 are coupled to processor(s) 26*a* to provide a three dimensional semantic building data model 28*a*, an artifact configuration data model 28*b* and a plurality of events received in real-time from various of the artifacts 28*b*. The pre-stored information at the units 28 is accessible to the module 26*c* to automatically produce verbal reports as to developing fire conditions via output port 32.

Port 32 can provide such verbal outputs via a speaker 34 substantially in real-time. Alternately, a textual description can be displayed or printed, as at 36.

Preferably, the physical building B is abstracted into a semantic building data model 28*a* and stored in the system 28. The configuration information about the detectors D (such as smoke detector, heat detector, etc) and the artifacts A (such as sprinkler, HVAC shut off, etc) are also be abstracted as artifacts configuration data model 28*b* and stored in the system 28.

The events A from the detectors D provide important information. For example, a smoke detector will send an event if it detected adjacent smoke. The difference between the events A from the aforementioned two data models is that these events are sent to system 28 at runtime with some specific representation format and stored as real time events 28*c* in system 28. Abstracting this configuration information and real time event information is discussed in detail subsequently.

The user can make different kinds of requests to the system 20. For example, in a firefighter system, the firefighter can ask for temporal and spatial information about the first alarm so that they can get information like "Smoke first detected 14 minutes ago in room 205 of floor 2, which is in NW corner of building". The firefighter also can ask for some updated information from last time he/she inquired so that they can get information such as, "Smoke detected 8 minutes ago in floor 6. From floor 6 to 7 at 4 minutes ago. Floor 6 has 5 active detectors, 5 new. Floor 7 has 3 active detectors, 3 new". Alternate output verbal form could be: "Four minutes ago, smoke was filling floor 6 and spreading from floor 6 to floor 7." As a result, the request can be defined with some parameters.

The Spatial Geometric Language Generation Module 26*c* receives a request from the user, via port 22. Module 26*c* will analyze its parameters, for example from system 28, and process that information to provide the requested verbal output.

These process include establishing the temporal relationship (such as 10 minutes ago), establishing the spatial relationship (in NW corner of the building, smoke is spreading to west), establishing a domain related meaningful description (such as smoke is spreading down the hallway), and so on. The system 20 integrates this semantic information for user and presents the result in a meaningful verbal description via speaker 34. The system 20 can display the result as the textual description 36 on a display screen 36*b* for the user.

Figure 3A:
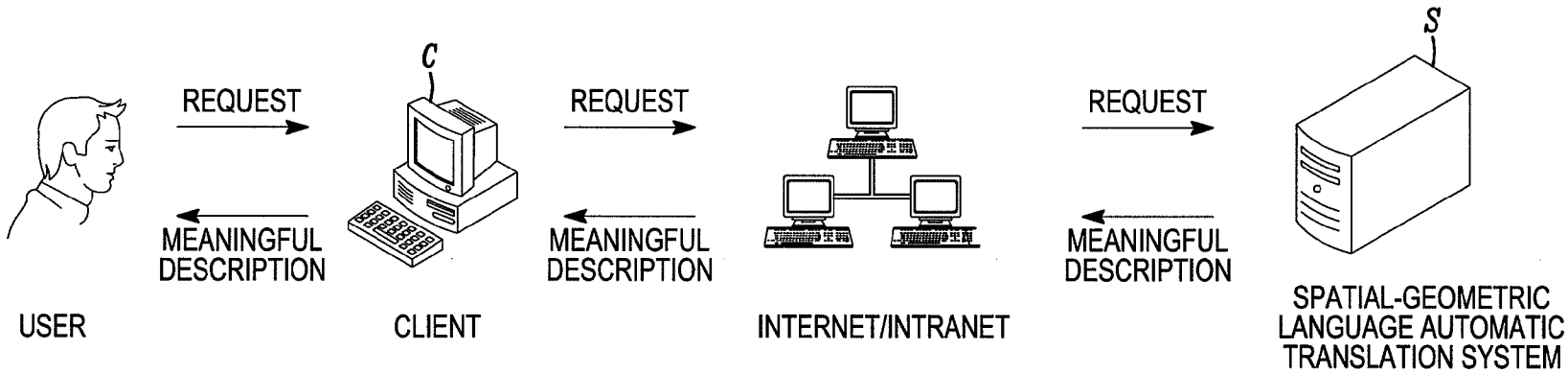
FIG. 3A illustrates a computer network-type embodiment of the invention.

The system 20 of FIG. 2 can also be implemented with a C/S (Client/Server) or a B/S (Browser/Server) mode via the internet/intranet, as FIG. 3A illustrates. In this embodiment, the user makes a request via the client C, which forwards the request by the internet/intranet to the "spatial geometric language automatic translation system" running on the server S. Once the meaningful output is generated, it is then returned to the user by the internet/intranet for verbal or visual presentation.

Figure 3B:
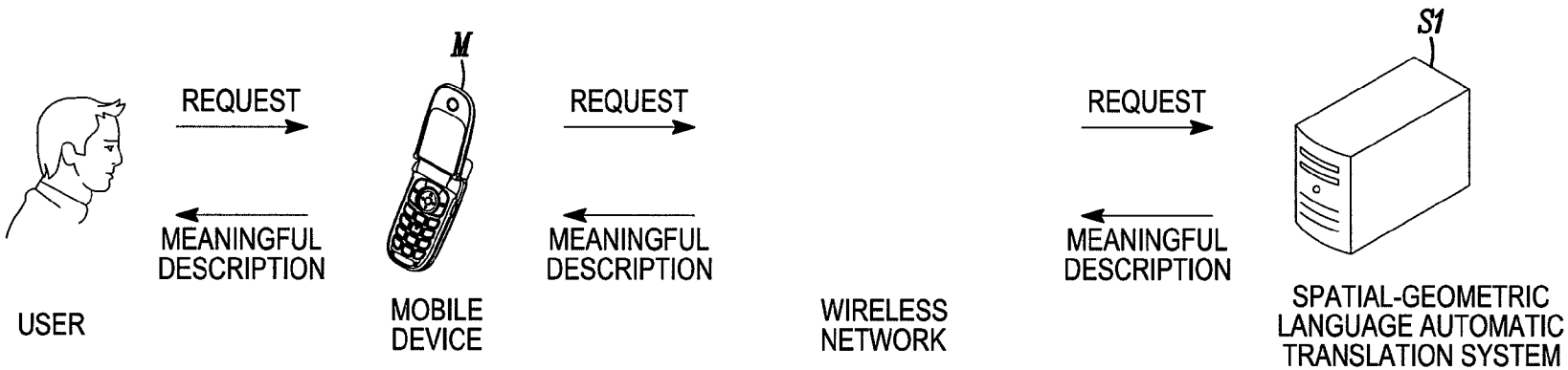
FIG. 3B illustrates an alternate embodiment of the invention.

The system can also be implemented using a mobile device M via a WWAN (Wireless Wide Area Network), as the FIG. 3B illustrates. In the embodiment, the user makes his request via the mobile device M. That request is forwarded by the wireless network to the "spatial geometric language automatic translation system" running on the server S1. Once the meaningful output is generated, it is then returned to user by the wireless network for verbal or audible presentation.

Different taxonomy methods can be used to semantically describe a building's elements. Table 1 illustrates an exemplary geometric element classification (The OmniClass Construction Classification System, known as OmniClass™ or OCCS, is a new classification system for the construction industry. Its website is http://www.omniclass.org/. Table 1 is called "Spaces by Form". The basic structure of the selected environment is delineated by physical or abstract boundaries and characterized by physical form. Other taxonomy methods or combination of several taxonomy methods also can be considered. The only requirement on the taxonomy is that the developer and the user can share its concepts well.

TABLE 1

| Space Type | Sub Type |
|---|---|
| Rooms | Room, Lobby, Hall, Auditorium, Anteroom, Office, Other Rooms |
| Atria | Gallery, Mall, Atrium, Enclosed Court, Other Atria |
| Shafts | Stair Enclosure, Elevator Shaft, Mechanical Shaft, Other Shafts |
| Transition Spaces | Corridor, Vestibule, Nave, Other Transition Spaces |
| Raised Spaces | Mezzanine, Balcony, Stage, Platform, Other Raised Spaces |

A building can include several levels and each level can have several spaces, such as rooms, shafts, raised spaces, and so on. Each floor can be drawn or rendered for a user to observe. Images can be represented as raster images (such as JPG, BMP, etc) or vector graphs (such as WMF, SVG, etc), and 3D model can be represented as triangle mesh. To get more meaningful output, each object should also have a human-understandable name associated with its type. A building can then be abstracted using the following definition:

| | |
|---|---|
| Building := | ID, Name, {Level} |
| Level := | ID, Name, Level_Type, Image, {Space} |
| Space := | ID, Name, Space_Type, Area |
| Level_Type := | Level \| Floor \| Story \| Basement \| Attic \| Other Levels |
| Area := | {x, y} |

The above abstraction definition complies with EBNF syntax (Extended Backus-Naur form). A Building can thus be defined as an ID, a Name and several Levels; define Level as an ID, a Name, a Level_Type, an Image and several Spaces; and define Space as an ID, a Name, a Space_Type and several Areas. Level_Type and the Space_Type comply with OmniClass classification, and Space_Type is listed in Table 1.

Here, ID is GUID; Name is a string for human to read; Image is the object which human can observe; Area, defined as a polygon with point list, is the region an object element covers. The information can be used during the processes of the spatial geometric language automatic translation system. For example, the Area information can help us to know which space a sensor or an artifact is equipped in. The Area information also can help us to do some deduction. For example, we seldom see a floor plan draw its hall way, but we can get the hall way by subtracting the spaces from the levels. Another example is, with the building ID, we can retrieve other information from the building's database so that we can know its owner, manager, address and so on.

Figure 4:
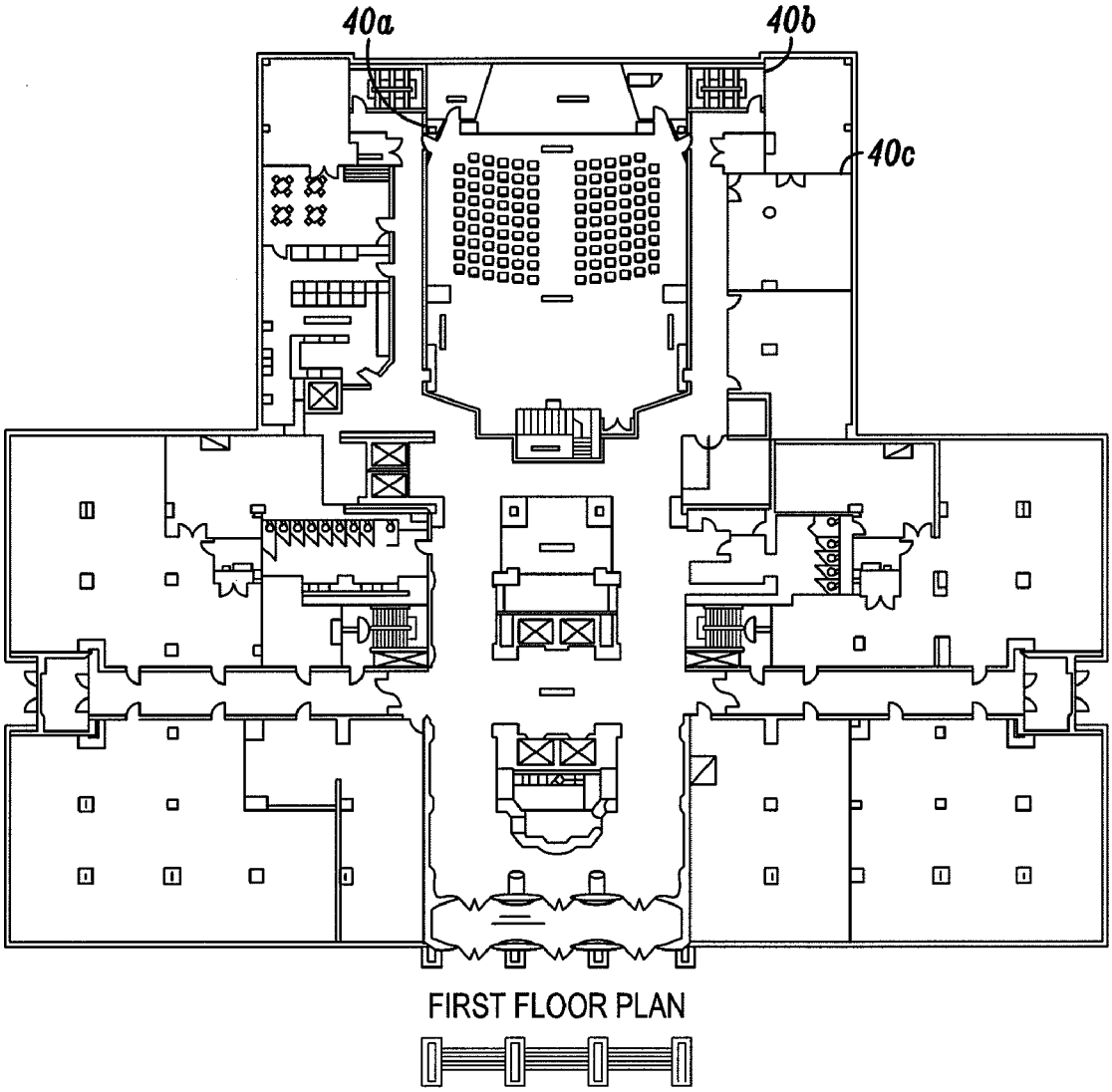
FIG. 4 illustrates a top plan view of a region of a building.

With reference to the floor plan of FIG. 4, three building elements can be represented with three polygons 40*a, b, c* at the upper-right corner. These are Auditorium, Stair Enclosure and Office respectively. These three elements can be represented as in Table 2 below:

TABLE 2

| | | |
|---|---|---|
| Space1 :=<br>ID = "000131",<br>Name = "Audit Room",<br>Type = "Auditorium"<br>Area = "56.724, 84.761; 56.724, 122.246; 85.915, 122.246; 85.915, 84.671; 81.116, 82.292; 81.116, 79.746; 76.500, 79.746; 76.500, 82.792; 66.500, 82.792; 66.500, 79.746; 62.500, 79.746; 62.500, 82.792" | Space2 :=<br>ID = "000147",<br>Name = "North Stair",<br>Type = "Stair Enclosure"<br>Area = "85.915, 122.246; 95.500, 122.246; 95.500, 117.833; 85.915, 117.833" | Space3 :=<br>ID = "000159",<br>Name = "Office2",<br>Type = "Office"<br>Area = "91.000, 110.146; 105.000, 110.146; 105.000, 96.346; 91.000, 96.346" |

And then the level and the building can be represented as:

| | |
|---|---|
| Level1 :=<br>ID = "000011",<br>Name = "Floor1",<br>Type = "Floor",<br>Image = floor1.wmf<br>....., Space1, Space2, Space3, ..... | Building1 :=<br>ID = "000001",<br>Name = "Modern Office Center",<br>Type = "Building",<br>....., Leve1, ..... |

In addition to the above abstraction, the building elements can be represented using a BIM/IFC format (BIM—Building Information Models, a collection point for information about a facility. This is unlike traditional approaches which scatter the information about a facility in multiple products so one can't get a clear picture of what is happening in the one facility of interest. BIM is intended to be an open standard based repository of information for the facility owner/operator to use and maintain throughout the life-cycle of a facility. Its website is http://www.facilityinformationcouncil.org/bim. IFC—Industry Foundation Classes, a standard to define an exchange format for information related to a building and its surroundings. Its website is http://www.iai-tech.org/).

With the building element description, the following meaningful output can be generated:

"Smoke first detected in room 205 of floor 2"

"Room 205 of floor 2 is a room with hazardous material"

"Smoke is spreading down the hallway"

"Floor 2 has 8 active detectors"

To meaningfully describe the building elements, it is preferable to also describe the orientation, direction or location. For example, in firefighting system, if the firefighter can clearly know the location of the first fire spot and its spread direction, they can save much time to deduce and assume the fire situation.

A compass system can be generated for the building using a semantic model—a unit vector as its north direction points to:

Compass:=x, y

Here, x and y are the float values with the constraint $x^2+y^2=1$. With the vector, we can define 8 spatial relationships (North, West, South, East, Northwest, Southwest, Southeast, and Northeast) between two points, as the FIG. 4 (in upright corner) shows and use OrientationRelation to represent the spatial relationship. For example, if point $B(x_2, y_2)$ is in the east of $A(x_1,y_1)$, it can be represented as:

OrientationRelation(B, A)=East

A function angle $(v_1,v_2)$ can be defined to represent the angle between two vectors $v_1,v_2$. So the OrientationRelation (B, A) can be abstracted by the following equation:

$$\text{OrientationRelation}(B, A) = \begin{cases} \text{North}, & -\pi/8 \le \text{angel}(B-A, (x, y)) < \pi/8 \\ \text{NorthWest}, & -3\pi/8 \le \text{angel}(B-A, (x, y)) < -\pi/8 \\ \text{West}, & -5\pi/8 \le \text{angel}(B-A, (x, y)) < -3\pi/8 \\ \text{SouthWest}, & -7\pi/8 \le \text{angel}(B-A, (x, y)) < -5\pi/8 \\ \text{South}, & -\pi \le \text{angel}(B-A, (x, y)) < -7\pi/8, \\ \text{South}, & 7\pi/8 \le \text{angel}(B-A, (x, y)) < \pi \\ \text{SouthEast}, & 5\pi/8 \le \text{angel}(B-A, (x, y)) < 7\pi/8 \\ \text{East}, & 3\pi/8 \le \text{angel}(B-A, (x, y)) < 5\pi/8 \\ \text{NorthEast}, & \pi/8 \le \text{angel}(B-A, (x, y)) < 3\pi/8 \end{cases} \quad (1)$$

Figure 5:
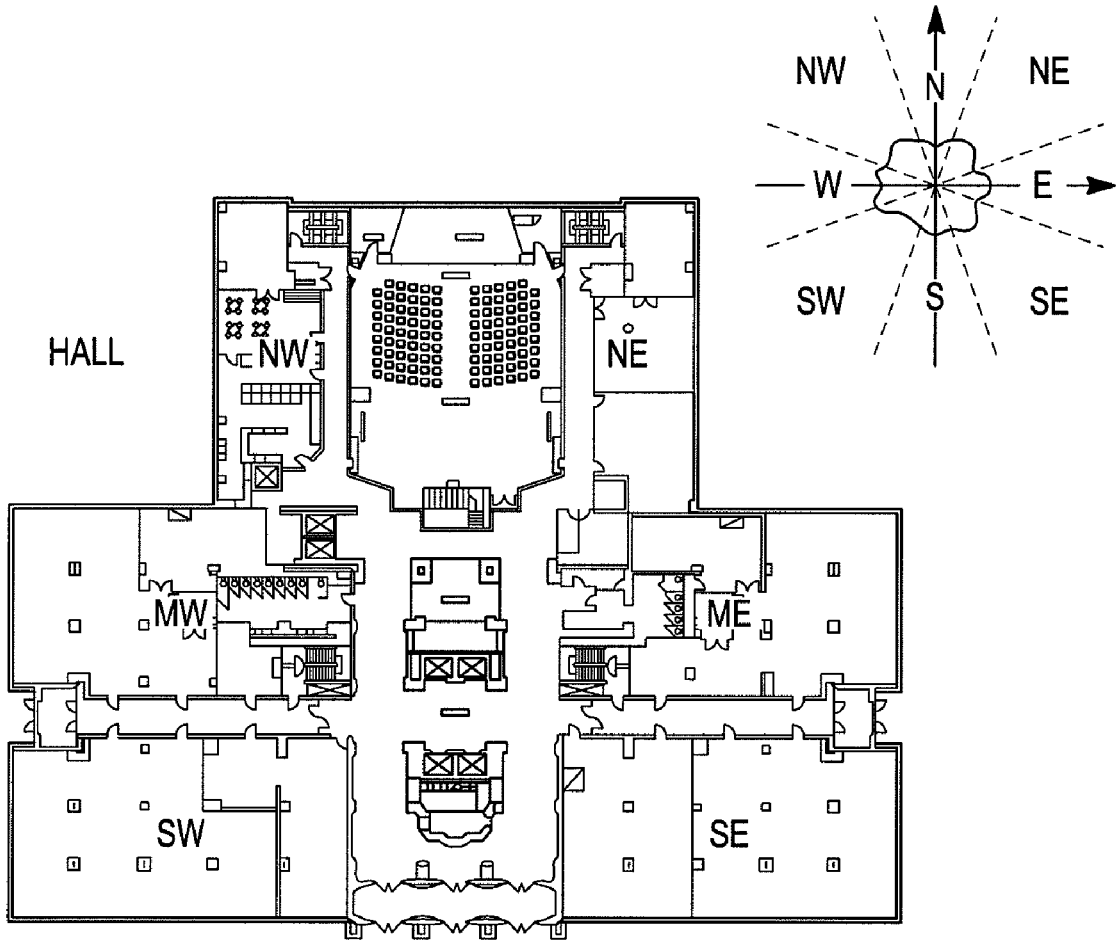
FIG. 5 illustrates another view of the region of FIG. 4.

Beside the above relative spatial relationship, some absolute spatial relationships can be defined, such as northeast corner of building, as FIG. 5 illustrates. With the above compass system, a developer can assign some area as absolute spatial area, as follows:

| | |
|---|---|
| SpatialArea := | SpatialAreaType, Area |
| SpatialAreaType := | E Corner \|NW Corner \| SE Corner \| SW Corner \| MW part \| ME part \| MN part \| MS part |
| Area := | {x, y} |

Here, Area, defined as a polygon with point list, is the region an absolute spatial area covers. And the SpatialAreaType defines type of a spatial area, for example, it is the North West corner of a building, or Middle West part of a building, and so on.

With the building orientation description, the following meaningful output can be generated:

"Room 205 of floor 2 is in the NW corner of the building"

"Smoke is spread to east"

With the building element description and orientation description, now a building semantic model can be abstracted as:

| | |
|---|---|
| Building := | ID, Name, Compass, {Level} |
| Level := | ID, Name, Level_Type, Image, {Space}, {SpatialArea} |
| Space := | ID, Name, Space_Type, Area |
| Compass := | x, y |
| SpatialArea := | SpatialAreaType, Area |

With the building semantic model, the following meaningful output can be generated:

"Smoke is spreading east down the hallway on floor 5"

The artifacts configuration information only includes where the artifacts are installed and what kinds of type they are. So the artifacts configuration data model can be represented as:

| | |
|---|---|
| Artifacts := | {Artifact} |
| Artifact := | ID, Name, Artifact_Type, Level, Poistion |
| Artifact_Type := | FirePhone \| GasTank \| FireKeyBox \| LockedDoor \| FireExtingusherInterior \| SmokeVent \| FireDisplay \| Standpipe \| StairesPressurized \| EntryPoint \| GasShutoff \| PowerShutoff \| HVACShutoff \| SprinklerShutoff \| HalonShutoff \| SmokeDetector \| ChemicalDetector \| HeatDetector \| HeavyObject \| HighVoltage \| HazardousMaterial |
| Position := | x, y |

Here, ID is GUID; Name is a string for human to read; Level is defined in the building semantic model; x and y is the float values to represent the location of artifact in the image. The artifact type complies with the standard of NFPA (National Fire Protection Association) and MSDS (Material Safety Data Sheet).

Figure 6:
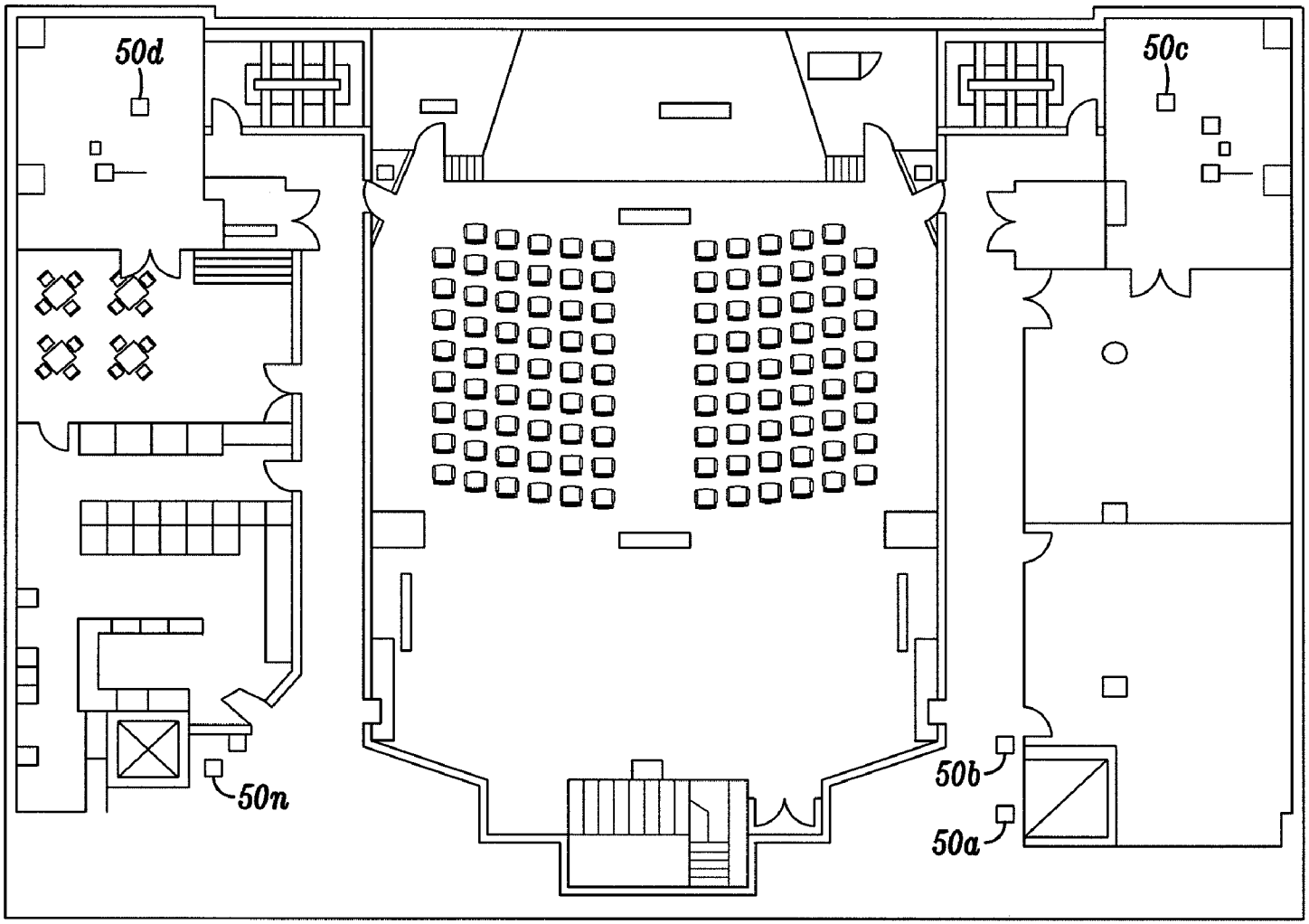
FIG. 6 illustrates a partial view of the region of FIG. 5.

In FIG. 6, artifacts 50*a, b, c, . . . n* are installed throughout the floor 1 of a building. Artifacts can be represented as:

| | |
|---|---|
| Artifact1 := | Artifact2 := |
| ID = "000821", | ID = "000932", |
| Name = "SD21", | Name = "HD32", |
| Type = "SmokeDetector" | Type = "HeatDetector" |
| Level = "Floor1" | Level = "Floor1" |
| Position = "112.915, 124.246" | Position = "87.915, 98.763" |
| Artifacts := | |
| ....., Artifact1, Artifact2, ..... | |

The event from the sensor only includes when the event is triggered and which artifact trigger the event. So the real time events can be represented as:

| | |
|---|---|
| Alarms : = | {Alarm} |
| Alarm : = | InstantTime, Artifact |

Here, Artifact is the artifact which triggers the event. The InstantTime is an instant time, such as Mar. 2, 2008, 15:03:22 ET, to represent when the event is triggered. The InstantTime complies with the OWL-Time (Time Ontology in OWL, W3C Working Draft 27 Sep. 2006, http://www.w3.org/TR/owl-time/).

Relative time appears to be more understandable for the firefighter. In addition to instant time, the Interval_Time can be used to represent the interval time (such as 5 minutes 22 seconds, 1 hour and 21 minutes) and only use ago to represent one of the temporal relations (such as 5 minutes ago).

With the time description, the following meaningful output can be generated:

"Smoke first detected 10 minutes ago"

"Smoke was from floor 2 to 3 at 9 minutes ago"

"Smoke is quickly spreading"

"Floor 6 has 5 active detectors, 5 is new"

With the Artifact Data Model and the Building Semantic Model, the data model for the Spatial Geometric Language Automatic Translation System can be abstracted as:

| | |
|---|---|
| Building := | ID, Name, Compass, {Level}, Artifacts, Alarms |
| Level := | ID, Name, Level_Type, Image, {Space}, {SpatialArea} |
| Space := | ID, Name, Space_Type, Area |
| Compass := | x, y |
| SpatialArea := | SpatialAreaType, Area |

-continued

| | |
|---|---|
| Area := | {x, y} |
| Artifacts := | {Artifact} |
| Artifact := | ID, Name, Artifact_Type, Level, Poistion |
| Alarms := | {Alarm} |
| Alarm := | InstantTime, Artifact |

Those of skill will understand that different applications have different description requirements. The description of smoke spreading in a firefighting application is illustrated as an example. Four kinds of request types (FirstAlarm, AlarmList, AlarmUpdate, AlarmSpread) can be defined. A variable LatestTime can also be defined. LatestTime is an Instant_time to represent the latest time when the system received a request from the user. For different request types, different translation processes can be provided.

Request Representation can be represented as:

| | |
|---|---|
| Request := | Request_Type |
| RequestType := | FirstAlarm \| AlarmList \| AlarmUpdate \| AlarmSpread |

First alarm can be described as:

"Smoke first detected var(IntervalTime) minutes ago in var(Space) var(Level),
which is in var (SpatialAreaType) of the building".

Figure 7:
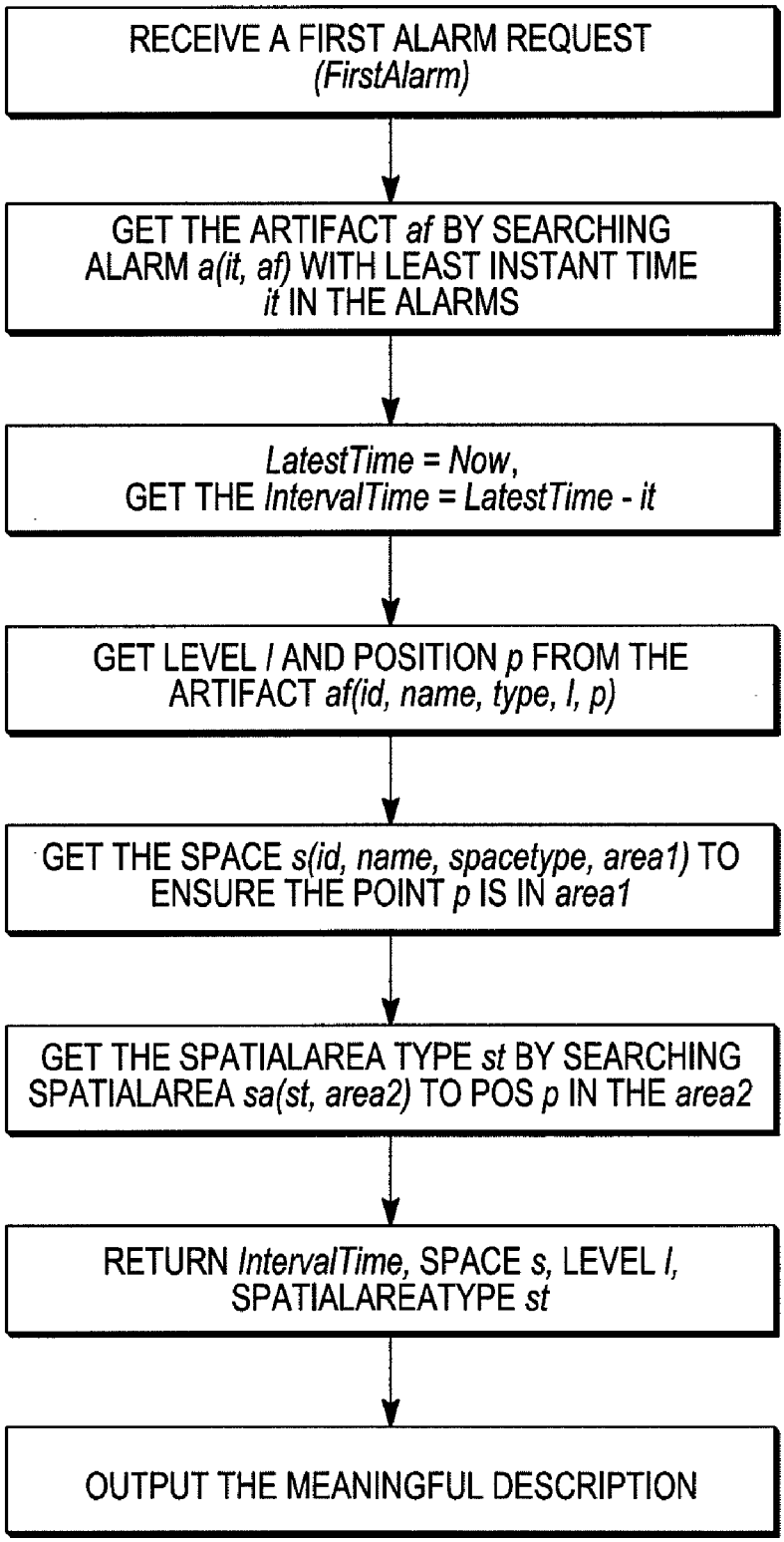
FIG. 7 is a flow diagram illustrating a first alarm translation process.

The var( ) means it is a variable, which will be deduced from the translation system's data model (including the Artifact Data Model and the Building Semantic Model). And the variable is determinable until the request is received from user. An example of first alarm is "Smoke first detected 14 minutes ago in room 205 of floor 2, which is in NW corner of building". The translation process of the first alarm is illustrated in FIG. 7.

Alarm list can be described as:

"Smoke spread from var(leve1l) to var( level2) at var(IntervalTime) minutes ago,
var(leve1l) has var(number1) active detector,
var(level2)has var(number2) active detector."

Figure 8:
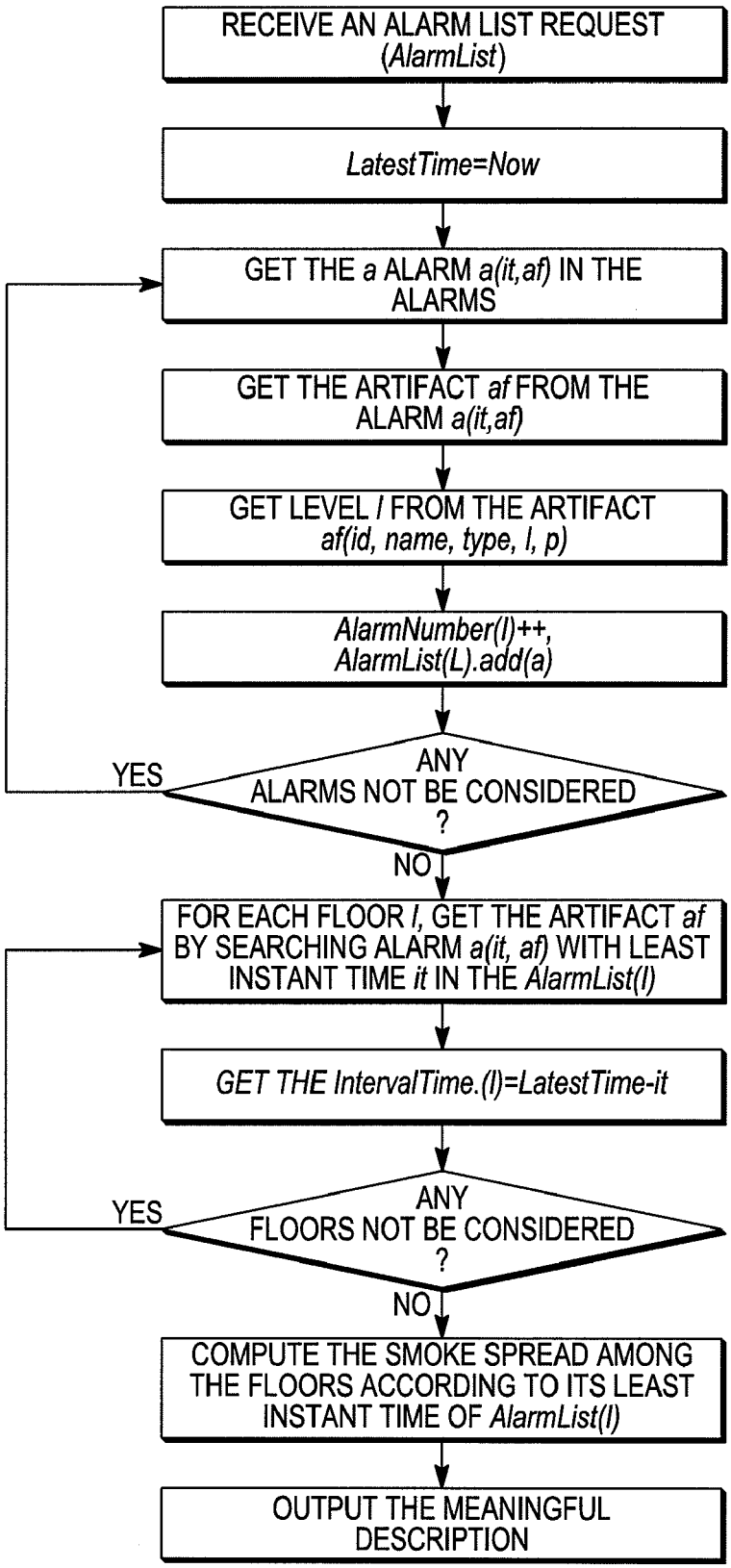
FIG. 8 is a flow diagram illustrating an alarm list translation process.

An example of alarm list is "Smoke spread floor 2 to 3 at 9 minutes ago, smoke spread from floor 3 to 4 at 2 minutes ago, floor 2 has 8 active detectors, floor 3 has 4 active detectors, and floor 4 has 2 active detectors". The translation process of the first alarm is shown in the flow diagram of FIG. 8.

Alarm update can be described as:

"var(level) has var(number1) active detectors, var(number2) are new."

Figure 9:
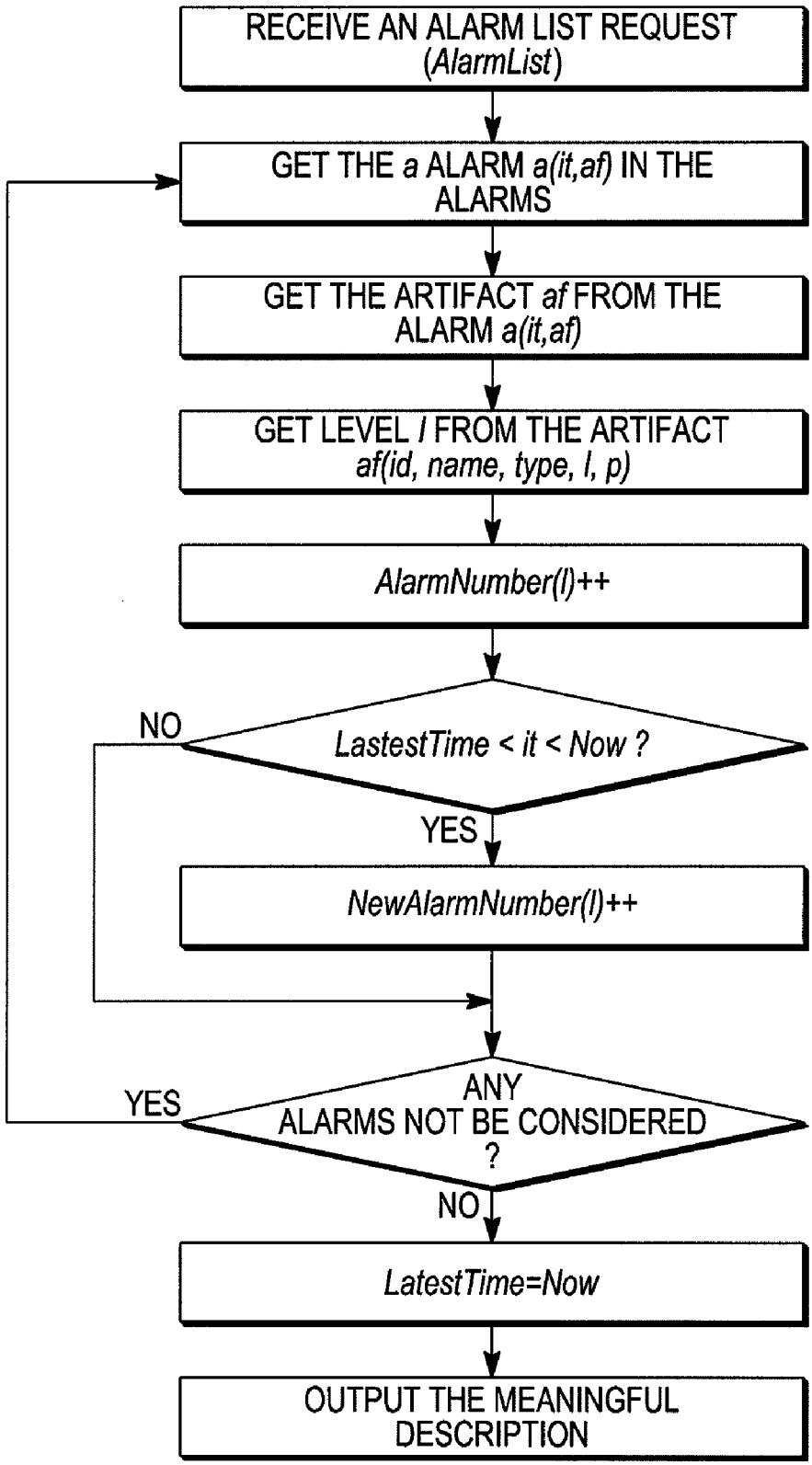
FIG. 9 is a flow diagram illustrating an alarm update translation process.

An example of alarm update is "Floor 6 has 5 active detectors, 3 are new; floor 7 has 3 active detectors, 3 new". The translation process of the first alarm is shown in the flow diagram of FIG. 9.

Alarm spread can be described as:

"The smoke is spreading var(orientationrealtion) [down var(space)] on
var(level)"

Figure 10:
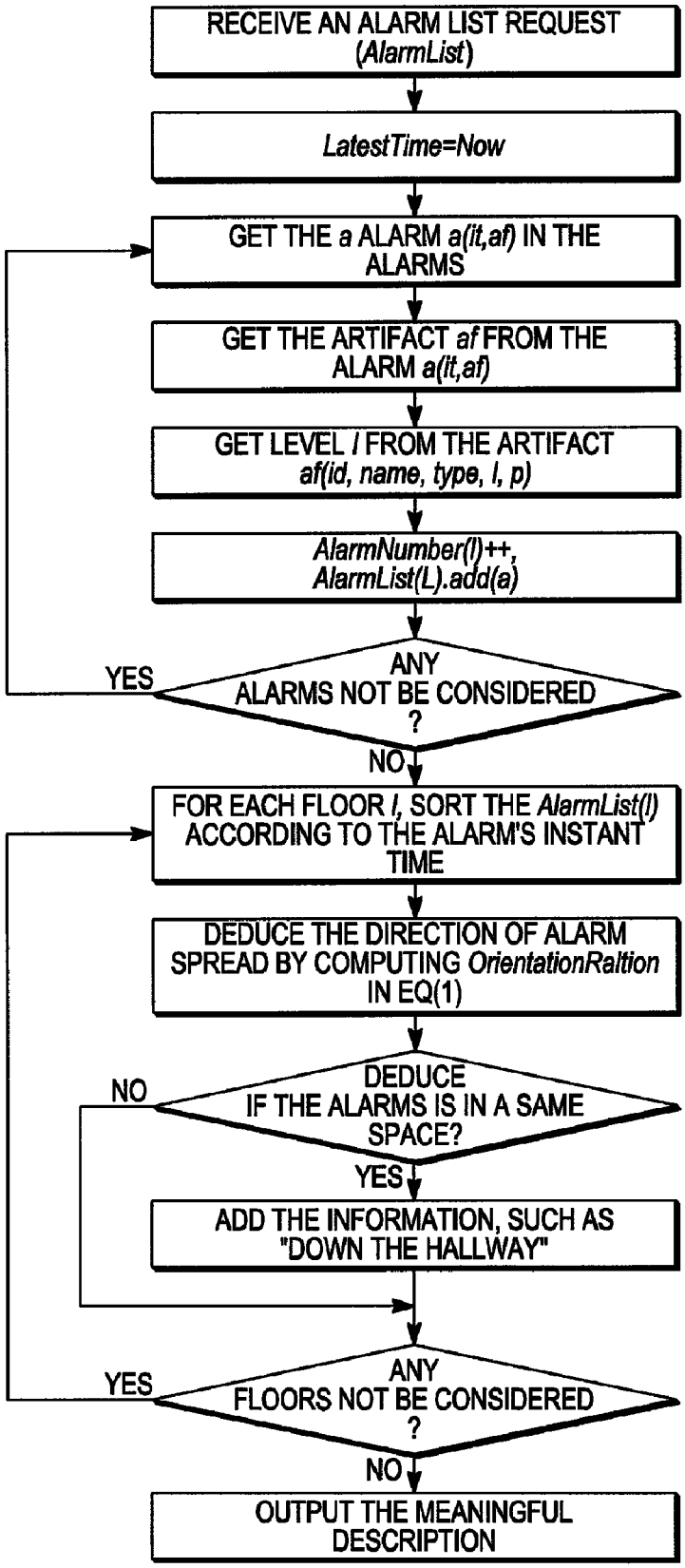
FIG. 10 is a flow diagram illustrating an alarm spread translation process.

An example of alarm spread is "The smoke is spreading east down the hallway on floor 5". The translation process of the first alarm is shown in the flow diagram of FIG. 10.

Those of skill will recognize the present invention is not limited to the above disclosed exemplary embodiments. For example, it could be used to track and provide verbal information as to the spread of other types of dangerous conditions, such as leaking fluids, or chemicals, or explosive gases, all without limitation. Moreover, different additional request types can be generated using different syntactical combinations of variables. Further, different rules for concatenating two or more different request types can be created to generate a whole natural language sequence of alarm event messages.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. An apparatus comprising:

a regional monitoring system that monitors a plurality of environmental conditions in a region;

at least one storage unit which includes at least one pre-stored abstracted data module related to the region; and analysis circuits coupled to the system and the storage unit, the circuits respond to developing conditions from the system by determining a temporal order and spatial order of any active alarms in the system and by combining the determined temporal and spatial orders with the pre-stored abstracted data module to automatically generate at least a verbal representation that verbally describes the developing condition.

2. An apparatus as in claim 1 which includes a display unit that presents a visual representation of the developing condition.

3. An apparatus as in claim 2 where the circuits are responsive to information stored in the storage unit to automatically generate the visual representation.

4. An apparatus as in claim 1 where the circuits generate revised verbal representations substantially in real-time in response to changing environmental conditions.

5. An apparatus as in claim 1 which includes in the at least one storage unit a pre-stored representation of the region.

6. An apparatus as in claim 1 where the monitoring system includes a plurality of ambient condition detectors and which includes pre-stored identifiers of the detectors and their respective locations in the region.

7. An apparatus as in claim 1 where the analysis circuit responds to real-time environmental condition events received from the monitoring system in generating verbal descriptions.

8. An apparatus as in claim 1 where the analysis circuits include at least one language generation module which responds to region related inputs, detector related inputs and real time events from respective detectors.

9. An apparatus as in claim 8 where the language generation module is coupled to a storage unit storing a building model, a detector configuration model and a plurality of received detector related events.

10. A method comprising:

storing at least one abstracted data module of a region;

monitoring environmental conditions in the region;

determining a temporal order and spatial order of any active alarms in the region;

combining the determined temporal and spatial orders of the active alarms in the region with the abstracted data module of the region;

automatically generating a verbal description of the developing condition based on the combination of the temporal and spatial orders of the active alarms with the abstracted data module of the region; and presenting the description verbally.

11. A method as in claim 10 which includes providing a pre-established representation of the region.

12. A method as in claim 11 which includes combining the representation of the region with characteristics of the developing condition in connection with automatically generating the verbal description.

13. A method as in claim 10 which includes providing an identification and location of ambient condition detectors in the region.

14. A method as in claim 13 which includes responding to condition specifying indicia from the detectors in connection with automatically generating the verbal description.

15. A method as in claim 14 which includes combining characteristics of the region along with the condition specifying indicia and the identity of condition detectors in the region.

16. A method as in claim 15 which includes receiving a request for a verbal description, and, where verbal descriptions are generated by combining variables from a building data model in various syntactical combinations.

17. A method as in claim 16 which includes forwarding the verbal description to a portable wireless output device.

18. A method as in claim 16 which includes retrieving pre-stored detector related information.

19. A method as in claim 18 which includes carrying out a language generation process to create the verbal description.

* * * * *